US010087589B2

(12) United States Patent
Yun et al.

(10) Patent No.: US 10,087,589 B2
(45) Date of Patent: Oct. 2, 2018

(54) VEHICLE SYSTEM FOR AUTOMATIC REPAIRING OF ROAD POTHOLES

(71) Applicant: SMART AIR CHAMBER CO., LTD., Seoul (KR)

(72) Inventors: Kyung Won Yun, Seoul (KR); In Song Park, Buchen-si (KR)

(73) Assignee: SMART AIR CHAMBER CO., LTD., Seoul (KR)

( * ) Notice: Subject to any disclaimer, the term of this patent is extended or adjusted under 35 U.S.C. 154(b) by 0 days.

(21) Appl. No.: 15/540,368

(22) PCT Filed: Nov. 24, 2015

(86) PCT No.: PCT/KR2015/012647

§ 371 (c)(1),
(2) Date: Jun. 28, 2017

(87) PCT Pub. No.: WO2016/108433

PCT Pub. Date: Jul. 7, 2016

(65) Prior Publication Data

US 2017/0342669 A1 Nov. 30, 2017

(30) Foreign Application Priority Data

Dec. 31, 2014 (KR) ..... 10-2014-0195201

(51) Int. Cl.
*E01C 23/07* (2006.01)
*E01C 23/10* (2006.01)

(52) U.S. Cl.
CPC ..... *E01C 23/07* (2013.01); *E01C 23/10* (2013.01)

(58) Field of Classification Search
CPC ..... E01C 23/10; E01C 23/07; E01C 23/14
See application file for complete search history.

(56) References Cited

U.S. PATENT DOCUMENTS 4,557,626 A * 12/1985 McKay ..... E01C 23/06 404/102
4,676,689 A * 6/1987 Yant ..... E01C 23/06 404/101

(Continued)

FOREIGN PATENT DOCUMENTS

KR 100714162 B1 * 4/2007
KR 101334516 B1 * 11/2013

(Continued)

*Primary Examiner* — Abigail A Risic
(74) *Attorney, Agent, or Firm* — LRK Patent Law Firm

(57) ABSTRACT

A vehicle system for automatic repairing of road potholes includes: a laser camera that measures distance from a vehicle to the pothole and calculates surface area based on the image and distance information, a first support shaft that moves back and forth, a multi operation device that cuts and crushes asphalt and flattens asphalt concrete, a heating device that melts asphalt, an asphalt vacuum suction device that sucks in asphalt and stores fragments in a residue storage tank, an asphalt concrete storage tank that stores asphalt concrete and supplies asphalt concrete around the road pothole, a residue storage tank that stores crushed asphalt sucked in, an oil supply nozzle that supplies oil, an air supply pump that supplies strong air for cleaning, and a vehicle device that operates power switch, cutting device motor, asphalt vacuum suction device, air supply pump, asphalt concrete volume calculation part, and roller part.

6 Claims, 10 Drawing Sheets

(56) References Cited

U.S. PATENT DOCUMENTS 5,131,788 A * 7/1992 Hulicsko ..... E01C 19/38 404/108
5,236,275 A * 8/1993 Kneeland ..... E01C 19/4826 404/107
5,294,210 A * 3/1994 Lemelson ..... B05B 12/122 404/108
5,333,969 A * 8/1994 Blaha ..... E01C 19/46 404/102
5,584,597 A * 12/1996 Lemelson ..... E01C 23/06 299/41.1
5,803,661 A * 9/1998 Lemelson ..... E01C 23/07 299/41.1
6,619,882 B2 * 9/2003 Harvey ..... E01C 23/098 404/107
6,988,849 B1 * 1/2006 Zimmerman ..... E01C 23/06 404/75
8,167,513 B2 * 5/2012 Ryan ..... E01C 23/06 404/101
8,517,629 B2 * 8/2013 Gregerson ..... E01C 23/06 404/110
9,303,368 B2 * 4/2016 Reda ..... G05D 1/0011
9,903,078 B2 * 2/2018 Ali ..... E01C 23/07
2003/0069668 A1 * 4/2003 Zurn ..... E01C 19/006 700/245
2013/0155061 A1 * 6/2013 Jahanshahi ..... G06T 15/00 345/419
2015/0259864 A1 * 9/2015 Roy ..... E01C 19/1004 404/77
2016/0032536 A1 * 2/2016 Reda ..... G05D 1/0011 404/75
2016/0032540 A1 * 2/2016 Reda ..... E01C 11/005 404/75
2017/0204569 A1 * 7/2017 Shah ..... E01C 23/07
2017/0226709 A1 * 8/2017 Ali ..... E01C 23/07

FOREIGN PATENT DOCUMENTS

KR 20140030288 A * 3/2014
KR 101456565 B1 * 10/2014

* cited by examiner (a)

VEHICLE SYSTEM FOR AUTOMATIC REPAIRING OF ROAD POTHOLES

CROSS-REFERENCE TO RELATED APPLICATION(S)

The present application is a U.S. National Phase entry from International Application No. PCT/KR2015/012647, filed Nov. 24, 2015, which claims priority to Korean Patent Application No. 10-2014-0195201, filed Dec. 31, 2014, the disclosure of which is incorporated by reference herein in its entirety.

BACKGROUND OF THE INVENTION

1. Field of the Invention

This invention relates to a vehicle system for automatic repairing of road potholes formed on roads. In general, pothole repairing vehicles are completed by transporting asphalt concrete from an asphalt concrete factory to a pothole site, where workers clean up the pothole, pour asphalt concrete, and flatten the ground using a roller. The pothole repairing method above fails to supply exact amount of asphalt concrete needed to fill each pothole proportional to its size and involves rough estimation of the amount of asphalt concrete poured, requiring the roller flattening work.

2. Description of Related Art

The conventional method related to this invention is presented in a registered patent of the Republic of Korea, no. 10-1334516 (published on Nov. 28, 2013). In FIG. 1, the conventional damaged road repairing device is comprised of a vehicle attachment part (100) that can be attached to a front frame (no drawing symbol) or front vehicle body structure of a repair vehicle (1), a hopper (200) that is fixed onto the front side of the vehicle attachment part (100), a conveyor (30) connected to a bottom side of the hopper (200), a hardener inlet (400) on one side of the conveyor (300), and a compactor (500) to flatten asphalt concrete laid on the damaged road surface. In addition, it is desirable that the vehicle attachment part (100) attached to the frame of the repair vehicle (1) is formed in a way that can be attached and detached to and from the damaged road repair device. On the one hand, the hopper (200) used to store asphalt concrete, an asphalt material paid on the road surface, includes a crew (210) inside that allows asphalt concrete to move in a single direction. An ordinary motor (220) is equipped as a device to operate the screw (210), and a bottom side of the hopper (200) can be opened to drop asphalt concrete onto the conveyor (300). In addition, the conveyor (300) is fixed onto a bottom side of the hopper (200) so that when asphalt concrete stored in the hopper (200) is transferred by the screw (210) and dropped downwards, it moves dropped asphalt concrete forward and lays asphalt concrete on the damaged road surface from one end of the conveyor (300). The conveyor (300) is made with relatively narrow breadth, because major scope of the damaged road repair device is to repair narrow road damages and the range of asphalt concrete laid is now wide. In addition, a conveyor operating motor (310) is placed on a side at one end of the conveyor (300) so as to allow for caterpillar movement of the conveyor (300). The conveyor (300) is characterized by horizontal rotation around the bottom end side opposite to the other end with the conveyor operating motor (310).

SUMMARY OF THE INVENTION

The conventional damaged road repair device above has a problem of being incapable of automating the major processes such as defining of the damaged road surface, cutting of asphalt on the damaged part, fine crushing of asphalt cut off, and disposal of crushed fragments. In addition, the conventional method has another problem of being incapable of finding out accurate surface area of the damaged road surface and supplying asphalt concrete appropriate for surface area. Accordingly, the purpose of this invention is to accomplish easy and convenient repairing of road potholes by preparing for a moving vehicle that includes an asphalt concrete storage tank, a laser camera to calculate surface area of pothole on the damaged road surface, a cutting tool to decide and cut the damaged road surface, a crushing tool that crushes asphalt, a suction tool that sucks in crushed fragments, and an air cleaning tool that cleans up cut and crushed fragments.

The vehicle system of this invention for automatic repairing of road potholes with the above purpose is characterized by a vehicle that transports asphalt concrete to the pothole, a laser camera attached to the vehicle that measures distance from the vehicle to the pothole, takes image of the pothole, calculates surface area based on the image and distance information and sends pothole surface area and image information to a device on the vehicle, a first support shaft installed on a multi main shaft of the vehicle that moves back and forth, a multi operation device that can cut and crush asphalt and flatten asphalt concrete by vertically moving with the operation of a first rotation motor connected to the first support shaft, a heating device connected to front bottom side of the vehicle body for heating and melting of asphalt that moves vertically or back and forth using vertical operating cylinder and forward-reverse operating cylinder, an asphalt vacuum suction device that sucks in asphalt finely crushed by vacuum pump inside the vehicle and stores fragments in a residue storage tank, an asphalt concrete storage tank installed on the vehicle to store asphalt concrete and supply asphalt concrete around the road pothole using an asphalt concrete supply pump, a residue storage tank that collects and stores crushed asphalt sucked in by the asphalt vacuum suction device, an oil supply nozzle used to operate the oil supply tank and supply oil stored in an oil tank to around the pothole, an air supply pump that supplies strong air through an air supply nozzle for cleaning, and a vehicle device installed on driver's seat of the vehicle that operates a power switch connected to the heating device for power supply, controls laser camera operation, displays image information received from the laser camera on the display part, stores image information on DB, stores surface area of the pothole received from the laser camera on surface area DB, operates the cutting device motor to cut asphalt into size equivalent to surface area of the pothole based on image information, operates the crushing device motor to crush asphalt, operates the asphalt vacuum suction device to suck in crushed asphalt and store in the residue storage tank, operates the air supply pump to supply air through the air nozzle and clean the pothole, controls the asphalt concrete volume calculation part to calculate the amount of asphalt concrete required based on surface area of the pothole received from the laser camera, operates the asphalt concrete supply pump to supply asphalt concrete into the pothole, stores the amount of asphalt concrete on asphalt concrete DB, and controls operation of the roller part.

Advantageous Effects

The vehicle system of this invention for automatic repairing of road potholes comprised as above has an effect of conveniently and automatically repairing road potholes. In addition, another effect of this invention is reduced waste of asphalt concrete through calculation of surface area of pothole and determination of the amount of asphalt concrete used. In addition, yet another effect of this invention is one-body repair of potholes using a repair vehicle that crushes and recollects asphalt removed from potholes.

BRIEF DESCRIPTION OF DRAWINGS

FIG. 5(*b*) is a block diagram of the laser camera applied to this invention.

FIG. 6(*b*) is a perspective view of the heating device applied to this invention.

FIG. 6(*c*) is a block diagram showing side view of the heating device applied to this invention.

DETAILED DESCRIPTION OF THE INVENTION

The vehicle system of this invention for automatic repairing of road potholes with the above purpose can be described using FIGS. 2 through 11 as below.

Figure 1:
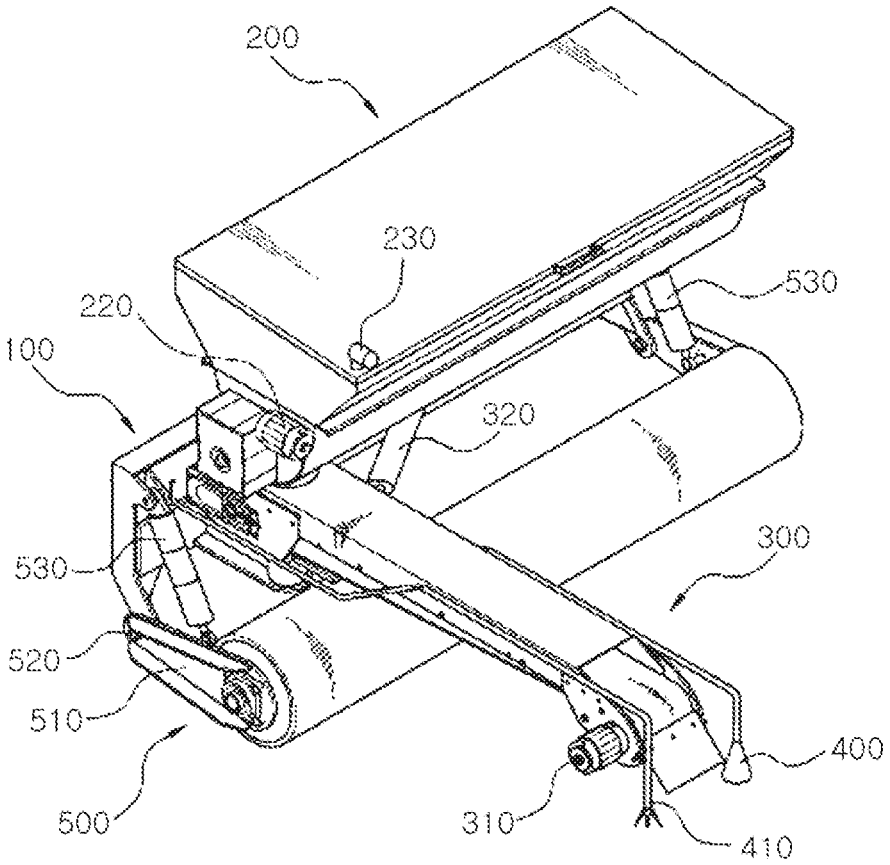
FIG. 1 RELATED ART
FIG. 1 is a block diagram of the conventional damaged road surface repair device.
Figure 2:
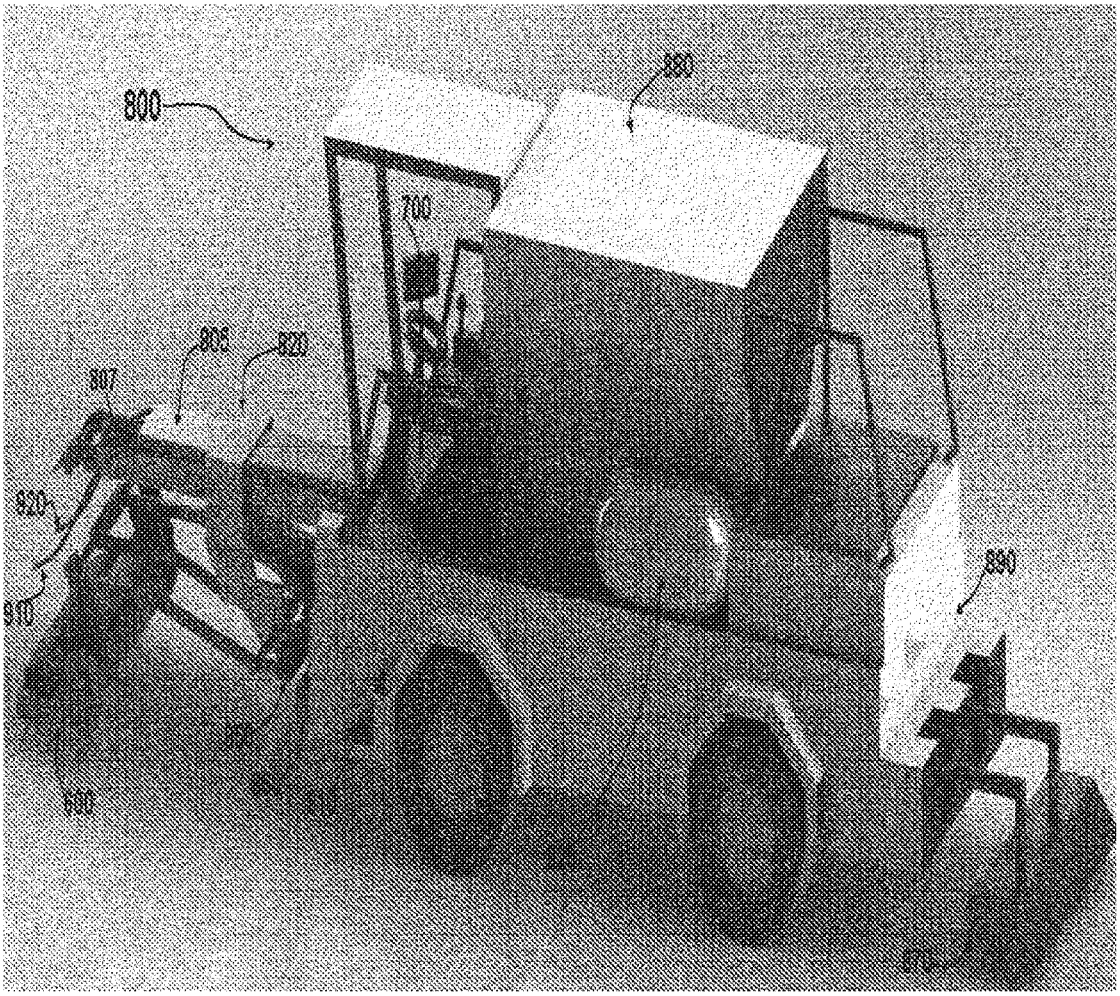
FIG. 2 is a perspective block diagram of the vehicle system of this invention for automatic repairing of road potholes.

FIG. 2 is a perspective block diagram of the vehicle system of this invention for automatic repairing of road potholes. In FIG. 2, the vehicle system of this invention for automatic repairing of road potholes is characterized by a vehicle (800) that transports asphalt concrete to a pothole, a laser camera part (810) attached to the vehicle that measures distance from the vehicle to the pothole, takes image of the pothole, calculates surface area of the pothole based on image information and distance information and sends pot hole surface area and image information to a vehicle device, a first support shaft (820) installed on a multi main shaft connected to the vehicle that can move back and forth, a multi operation device (600) that cuts asphalt and flattens asphalt concrete by vertically moving with a first rotation operating part connected to the first support shaft (820), a crushing device (850) connected to the first support shaft (820) that finely crushes asphalt on the pothole by moving vertically, operating a crushing motor and rotating a grinder blade (851), a heating device (860) connected to the bottom front side of the vehicle body that heats and melts asphalt by moving vertically or back and forth through operation of vertical operating cylinder and forward-reverse operating cylinder, an asphalt vacuum suction device (870) installed in the back of the vehicle to suck in asphalt crushed by a vacuum pump installed inside the vehicle and stores asphalt in a residue storage tank, an asphalt concrete storage tank (880) that stores asphalt concrete, an asphalt concrete supply pump (not illustrated) that supplies asphalt concrete stored in the asphalt concrete storage tank to the pothole through a supply channel (807) formed within the multi main shaft, a residue storage tank (890) that gathers and stores asphalt crushed and sucked in and the asphalt vacuum suction pump, an oil supply nozzle (910) that operates an oil supply pump to supply oil stored in an oil tank for increased adhesion of asphalt concrete to the pothole, an air supply pump (925) installed inside the vehicle to clean up the pothole using strong air from an air supply nozzle (920), and a vehicle device (700) installed on driver's seat of the vehicle that operates a power switch connected to the heating device for power supply, controls laser camera operation, displays image information received from the laser camera on the display part, stores image information on DB, stores surface area of the pothole received from the laser camera on surface area DB, operates the cutting device motor to cut asphalt into size equivalent to surface area of the pothole based on image information, operates the crushing device motor to crush asphalt, operates the asphalt vacuum suction device to suck in crushed asphalt and store in the residue storage tank, operates the air supply pump (925) to supply air through the air nozzle and clean the pothole, controls the asphalt concrete volume calculation part to calculate the amount of asphalt concrete required based on surface area of the pothole received from the laser camera, operates the asphalt concrete supply pump to supply asphalt concrete into the pothole through a supply channel (807) formed inside the multi main shaft, makes the asphalt concrete volume calculation part to calculate the amount of asphalt concrete supplied by receiving changing weight of asphalt concrete from a digital gauge installed at the bottom of the asphalt concrete storage tank, stores the amount of asphalt concrete on asphalt concrete DB, and controls operation of the roller (677) on the multi operation device. When the roller is operated, the flattening part connected to the roller as a single body compresses asphalt concrete laid evenly throughout the pothole to help it harden on the road.

Figure 3:
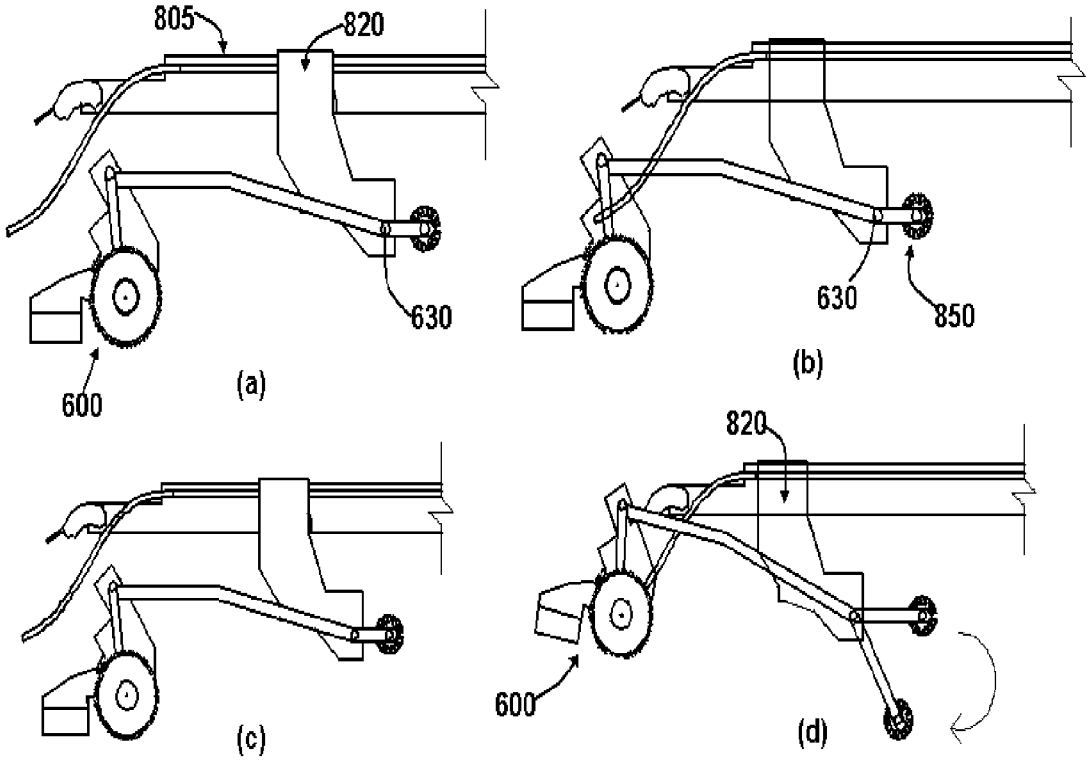
FIG. 3 is a block diagram explaining vertical movement of the multi operation device applied to this invention.

FIG. 3 is a block diagram explaining vertical movement of the multi operation device applied to this invention. In FIG. 3, the multi operation device (600) applied to this invention is installed between the first support shaft (820) and the multi main shaft (805), and it is comprised of a rack/gear part (610) that moves the first support shaft back and forth and a first rotation operating part (630) installed at the bottom of the first support shaft. When the operating motor of the first rotation operating part rotates clockwise around the first rotation operating part, the multi operation device (600) moves up and the crushing device (850) moves down. On the contrary, when the operating motor of the first rotation operating part rotates counterclockwise, the multi operation device moves down and the crushing device moves up like a seesaw. In addition, the first support shaft (820) moves forward if the rack/gear part (610) is operated clockwise and backward if operated counterclockwise. As above, when the first support shaft moves back and forth, the multi operation device and crushing device connected to the first support shaft also move back and forth. In FIG. 3, (a) illustrates the first support shaft in reverse state and (b) illustrates the first support shaft in forward state. In FIG. 3, (c) shows the multi operation device in lowered state according to the operating motor of the first rotation operating part, and (d) shows the multi operation device in elevated state.

Figure 4:
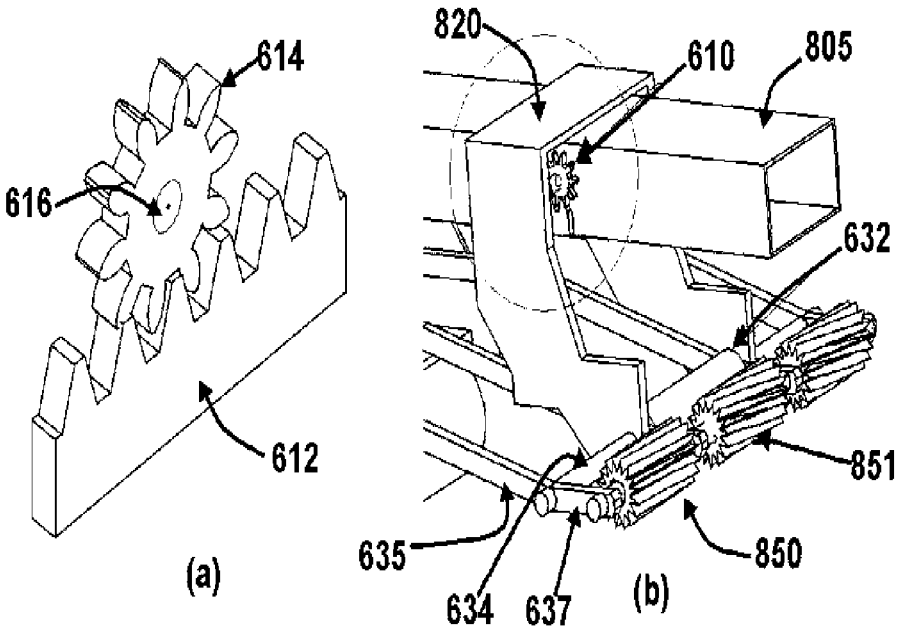
FIG. 4 is an enlarged block diagram of the rack/gear and first rotation operating part.

FIG. 4 is an enlarged block diagram of the rack/gear part and first rotation operating part. In FIG. 4, (a) is a block diagram of the rack/gear part and (b) is composition of the first rotation operating part. This operating part is comprised of a linear gear (612) installed on the multi main shaft (805), a motor installed on the inside of the first support shaft (820) as a single body, and a rotating gear (614) connected to the motor rotating shaft (616). When the motor is operated, the rotating gear (614) moves back and forth on the linear gear (612), allowing the first support shaft (820) installed with the motor to move back and forth. In FIG. 4, (b) shows the first rotation operating part 630) connected to the bottom of the first support shaft. The first rotation operating part (630) is comprised of an operating motor (632), a multi operation device (600) connected to a bar (635) on one side of the operating motor (632), and a crushing device (850) connected to the opposite bar (637) of the operating motor shaft (634). If the rotating motor rotates clockwise or counterclockwise, the crushing device (850) and multi operation device (600) can move vertically around the operating motor shaft (634) like a seesaw. In other words, the crushing device moves down and the multi operation device moves up when the operating motor rotates clockwise, and the multi operation device moves down and the crushing device moves up when the operating motor rotates counterclockwise.

Figure 5A:
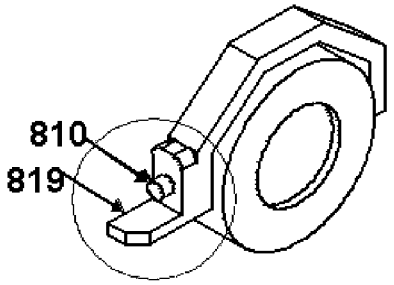
FIG. 5(*a*) is a perspective view of the laser camera applied to this invention.
Figure 5B:
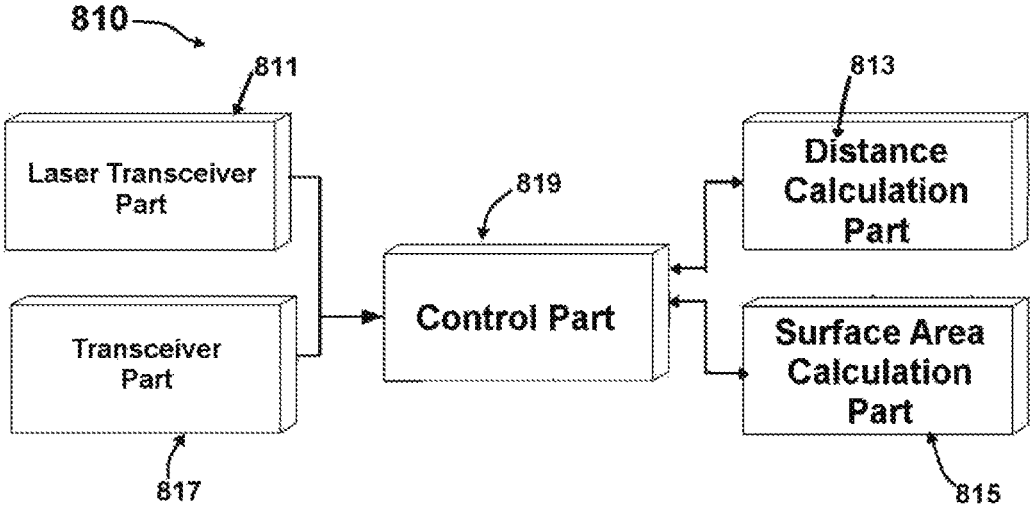

FIG. 5 is a block diagram showing installation of the laser camera applied to this invention. FIG. 5(*a*) is a perspective view of the laser camera and FIG. 5(*b*) is a block diagram of the laser camera. The laser camera part (810) applied to this invention is characterized by a laser transceiver part (811) installed on a bottom side of the vehicle body that shoots and receives laser at the pothole, a distance calculation part (813) that calculates distance based on transmission and reception signals of laser, a surface area calculation part (815) that calculates surface area of the pothole based on image information taken from the pothole and distance information calculated by the distance calculation part, a transceiver part (817) to transmit and receive surface area information and image information to and from the vehicle device, and a control part (819) that controls the laser transceiver part, distance calculation part, surface area calculation part and transceiver part.

Figure 6A:
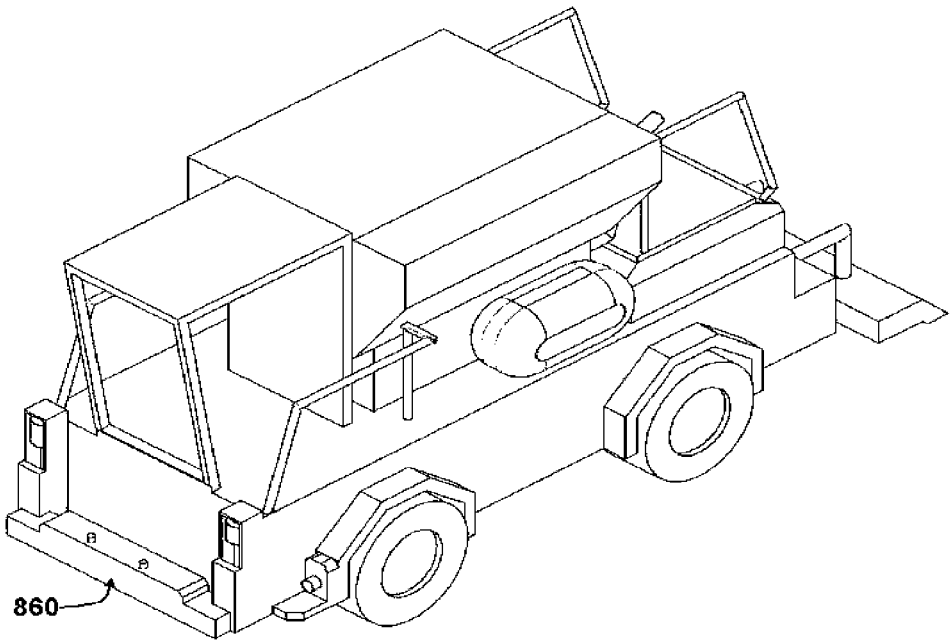
FIG. 6(*a*) is a heating device installed on the front bottom side of the vehicle applied to this invention.
Figure 6B:
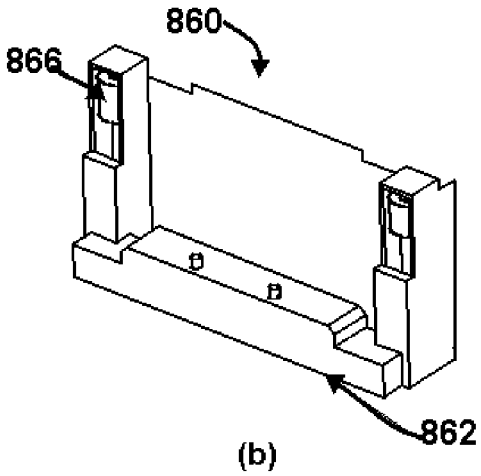
Figure 6C:
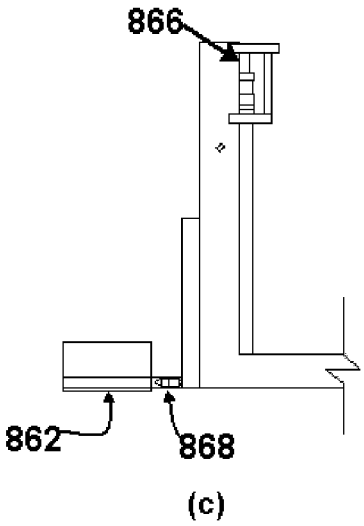

FIG. 6 is a block diagram of the heating device applied to this invention. FIG. 6(*a*) is the heating device installed on the front bottom side of the vehicle, FIG. 6(*b*) is a perspective view of the heating device, and FIG. 6(*c*) is a block diagram showing side view of the heating device. The heating device (860) applied to this invention is characterized by a heating plate (862) installed on the front bottom surface of the vehicle body, a switching part controlled by the vehicle device to turn power supply of the heating plate ON and OFF, a vertical operating cylinder (866) connected to the heating device to move the heating device vertically, and a forward-reverse operating cylinder (868) to move the heating device back and forth. When the vehicle moves close to the pothole, the heating device (860) can be placed nearby the pothole to heat the asphalt surface by operating the vertical operating cylinder (866) and forward-reverse operating cylinder (868). In other words, when power is supplied to the heating device (860), the heating plate of the heating device is heated and the pothole and asphalt around the pothole are melted down using the heating plate, allowing for easy cutting and crushing.

Figure 7:
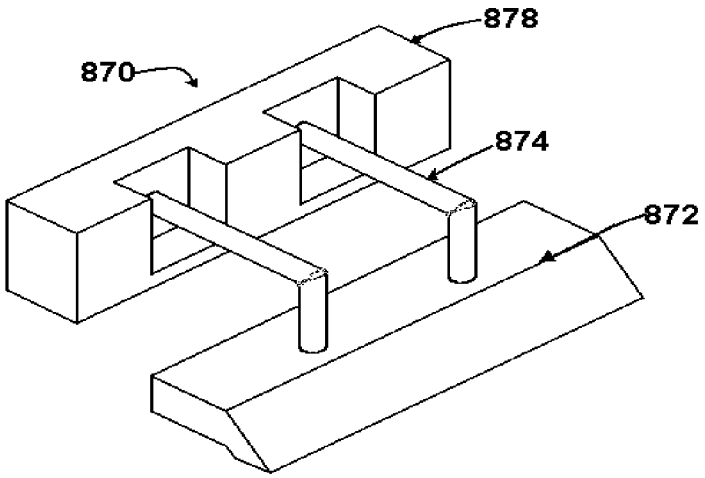
FIG. 7 is a block diagram of the crushed asphalt vacuum suction device applied to this invention.

FIG. 7 is a block diagram of the crushed asphalt vacuum suction device applied to this invention. As a perspective view of the asphalt vacuum suction device, FIG. 7 illustrates that the asphalt vacuum suction device (870) applied to this invention is comprised of a vacuum (872) that sucks in asphalt crushed by a vacuum pump installed on the vehicle, a vacuum tube (874) through which crushed asphalt is passed, and a residue storage tank (878) that stores crushed and sucked asphalt.

Figure 8:
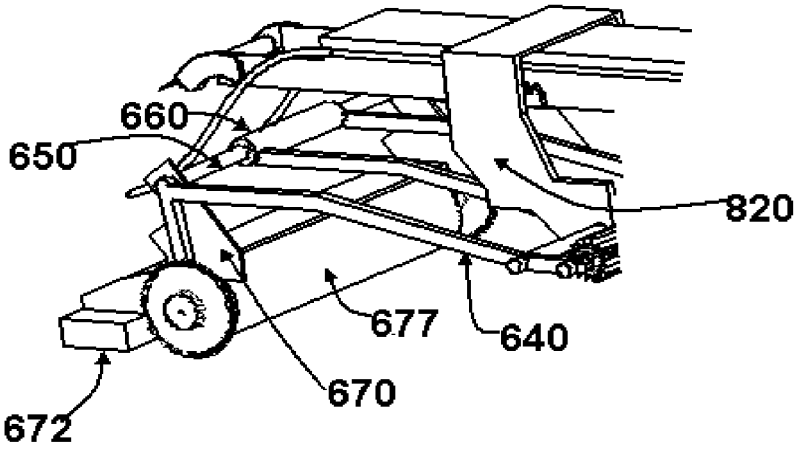
FIG. 8 is a block diagram of the multi operation device applied to this invention.

FIG. 8 is a detailed block diagram of the multi operation device. In FIG. 8, the multi operation device (600) is comprised of several operation bars (640) connected to the first support shaft (820), a cutting rotation motor shaft (650) connected to the several operation bars (640), a cutting motor (660) that rotates the cutting rotation motor shaft, two second brackets (670) connected to the cutting rotation motor shaft (650) at both ends, a flattening part (672) connected to the front side of the two second brackets (670) to flatten asphalt concrete, a roller part (677) connected to the two second brackets (670) with a roller motor to flatten the pothole supplied with asphalt concrete, and a cutting blade (679) with a blade motor connected at both ends of the cutting rotation motor shaft (650). The multi operation device (600) can forward-reverse operate the cutting motor to descend the cutting device (676) vertically to place it near the pothole and cut repair area of the pothole by operating the blade motor and rotating the cutting blade. Once cutting of the pothole is finished by the cutting device, the vehicle device operates the cutting motor of the cutting device to move the cutting device up. The vehicle device operates the crushing device (850) to finely crush asphalt and operates the asphalt vacuum suction device (870) to suck in and store crushed asphalt. In addition, after cleaning the pothole using air and supplying asphalt concrete, the vehicle device operates the operating motor of the first rotation operating part to descend the multi operation device, and the vehicle device then operates the roller part (677) of the multi operation device to flatten asphalt concrete.

Figure 9:
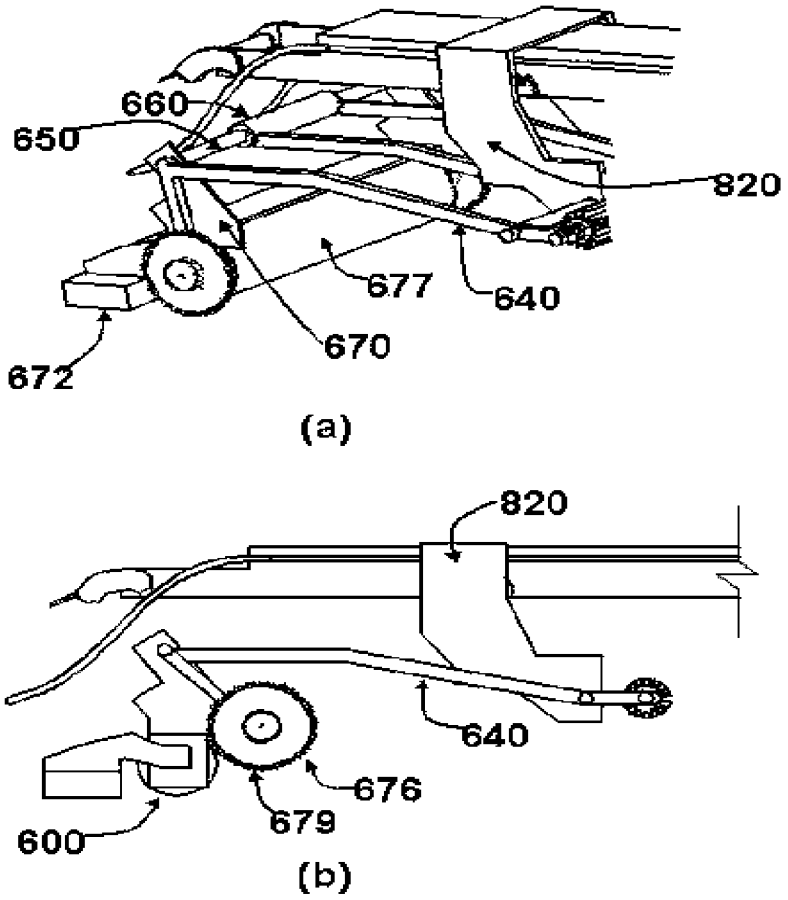
FIG. 9 is a block diagram showing vertical movement of the cutting device applied to this invention.

FIG. 9 is a block diagram showing vertical movement of the cutting device. In FIG. 9, (a) illustrates the cutting device (676) moved down to the pothole and (b) illustrates the cutting device (676) moved up by the cutting motor (660). The cutting device (676), moved vertically by the cutting motor (660) of the multi operation device, is comprised of a cutting motor (660), a cutting rotation motor shaft (650) connected to the cutting motor, and a cutting blade (679) with a cutting motor connected to both ends of the cutting rotation motor shaft (650). The cutting device is vertically moved by forward-reverse rotation of the cutting motor, and the cutting blade is connected to the blade motor and rotation shaft of the blade motor.

Figure 10:
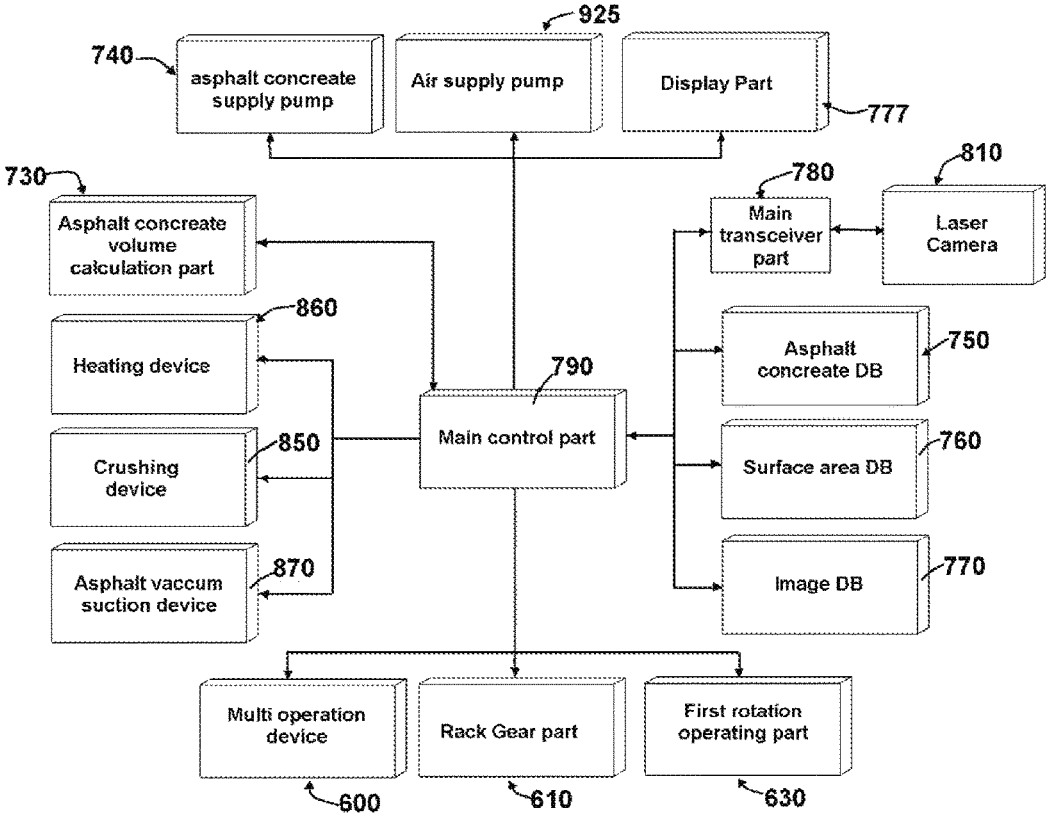
FIG. 10 is a block diagram of the vehicle device applied to this invention.

FIG. 10 is a block diagram of the vehicle device applied to this invention. The vehicle device (700) applied to this invention is characterized by a main control part (790) with a main transceiver part (780) to transmit and receive data to and from the laser camera. The vehicle device (700) controls the heating device (860) by turning the power supply switch of the heating device ON and OFF, controls and operates the laser camera (810), displays image information received from the laser camera on the display part (777), stores image information on image DB (770), stores surface area information of the pothole received from the laser camera on surface area DB (760), operates the blade motor of the cutting device of the multi operation device (600) to cut the pothole based on image information, operates the crushing device (850) motor to crush asphalt, operates the asphalt vacuum suction device (870) to suck in crushed asphalt and store it in the residue storage tank, operates the air supply pump (925) to supply air through the air supply nozzle (920) and clean the pothole, controls the asphalt concrete volume calculation part (730) to calculate the amount of asphalt concrete required based on surface area information of the pothole received from the laser camera, operates the asphalt concrete supply pump (740) to supply asphalt concrete in the asphalt concrete storage tank to the pothole based on the amount of asphalt concrete required, makes the asphalt concrete volume calculation part to calculate the amount of asphalt concrete supplied by receiving asphalt concrete weight information of the asphalt concrete storage tank from the digital gauge installed at the bottom of the asphalt concrete storage tank, stores the amount of asphalt concrete supplied on asphalt concrete DB (750), controls the motor of the rack/gear part (610) and the operating motor of the first rotation operating part (630), and controls operation of the roller part of the multi operation device (600).

Figure 11:
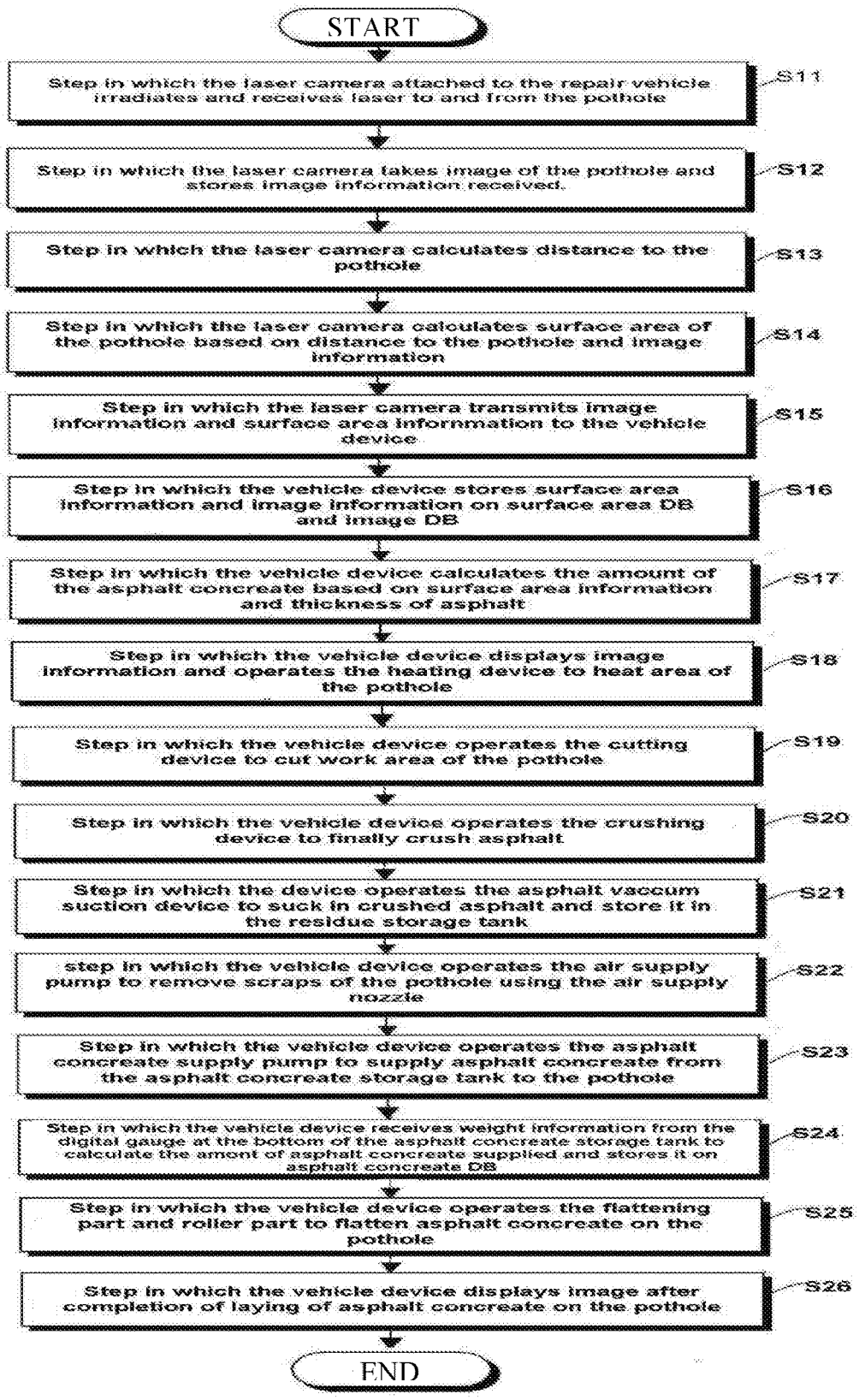
FIG. 11 is a control flow chart illustrating the automatic repairing method for road potholes applied to this invention.

FIG. 11 is a control flow chart illustrating the automatic repairing method for road potholes applied to this invention. In FIG. 11, the automatic repairing method for road potholes applied to this invention is characterized by a step (S11) in which the laser camera attached to the repair vehicle irradiates and receives laser to and from the pothole, a step (S12) in which the laser camera takes image of the pothole and stores image information received, a step (S13) in which the laser camera calculates distance to the pothole, a step (S14) in which the laser camera calculates surface area of the pothole based on distance to the pothole and image information, a step (S15) in which the laser camera transmits image information and surface area information to the vehicle device, a step (S16) in which the vehicle device stores surface area information and image information on surface area DB and image DB, a step (S17) in which the vehicle device calculates the amount of asphalt concrete based on surface area information, a step (S18) in which the vehicle device displays image information and operates the heating device to heat work area of the pothole, a step (S19) in which the vehicle device operates the cutting device to cut work area of the pothole, a step (S20) in which the vehicle device operates the crushing device to finely crush asphalt, a step (S21) in which the vehicle device operates the asphalt vacuum suction device to suck in crushed asphalt and store it in the residue storage tank, a step (S22) in which the vehicle device operates the air supply pump to remove scraps of the pothole using the air supply nozzle, a step (S23) in which the vehicle device operates the asphalt concrete supply pump to supply asphalt concrete from the asphalt concrete storage tank to the pothole, a step (S24) in which the vehicle device receives weight information from the digital gauge at the bottom of the asphalt concrete storage tank to calculate the amount of asphalt concrete supplied and stores it on asphalt concrete DB, a step (S25) in which the vehicle device operates the flattening part and roller part to flatten asphalt concrete on the pothole, and a step (S26) in which the vehicle device displays image after completion of laying of asphalt concrete on the pothole. Calculation of the amount of asphalt concrete supplied is characterized by receiving of weight information from the gauge installed at the bottom of the asphalt concrete storage tank by the vehicle device for calculation. In addition, the step that calculates the amount of asphalt concrete required multiplies surface area of the pothole by thickness of asphalt, which is 10 cm~15 cm. In addition, an additional step can be added between S22 and S23 to operate the oil supply pump, which supplies oil through the oil supply nozzle to reinforce adhesion of asphalt concrete.

INDUSTRIAL APPLICABILITY

The vehicle system of this invention for automatic repairing of road potholes, which automatically repairs a pothole on a road by taking image of the pothole, calculating surface area of the pothole, supplying asphalt concrete appropriate for surface area, and flattening asphalt concrete, is a practical system that can be applied to actual production sites in order to guarantee safety and efficiency of workers.

The invention claimed is:

1. A vehicle system for automatic repairing of road potholes on a road, the vehicle system comprising:

a vehicle (800) that transports asphalt concrete to a pothole;

a laser camera part (810) that is attached to the vehicle, measures a distance from the vehicle to the pothole, takes an image of the pothole, calculates a surface area of the pothole based on the image information and the distance information, and sends the pot hole surface area information and the image information to a vehicle device;

a first support shaft (820) that is installed on a multi main shaft (805) connected to the vehicle to move back and forth, and comprises a linear gear (612) installed on the multi main shaft (805), a motor installed on the inside of the first support shaft (820) as a single body, and a rotating gear (614) connected to a motor rotating shaft (616), wherein when the motor is operated, the rotating gear (614) moves back and forth on the linear gear (612), allowing the first support shaft (820) provided with the motor to move back and forth;

a multi operation device (600) that cuts asphalt and flattens asphalt concrete by vertically moving, with a first rotation operating part connected to the first support shaft (820);

a crushing device (850) that is connected to the first support shaft (820), and finely crushes the asphalt on the pothole by moving vertically, operating a crushing motor and rotating a grinder blade (851);

a heating device (860) that is connected to the bottom front side of the vehicle body, and heats and melts the asphalt by moving vertically or back and forth through operation of a vertical operating cylinder and a forward-reverse operating cylinder;

an asphalt vacuum suction device (870) that is installed in the back of the vehicle to suck in the crushed asphalt by a vacuum pump installed inside the vehicle and to store the asphalt in a residue storage tank;

an asphalt concrete storage tank (880) that stores the asphalt concrete;

an asphalt concrete supply pump (740) that supplies the asphalt concrete stored in the asphalt concrete storage tank to the pothole through a supply channel (807) formed inside the multi main shaft (805);

a residue storage tank (890) that gathers and stores the crushed asphalt sucked in by the asphalt vacuum suction device;

an oil supply nozzle (910) that operates an oil supply pump to supply oil stored in an oil tank for increased adhesion of the asphalt concrete to the pothole;

an air supply pump (925) that is installed inside the vehicle to clean up the pothole using strong air from an air supply nozzle (920); and a vehicle device (700) that is installed on driver's seat of the vehicle, operates a power switch connected to the heating device for power supply, controls operation of the laser camera part, displays the image information received from the laser camera part on a display part, stores the image information on an image DB, stores the surface area of the pothole received from the laser camera part on a surface area DB, operates a cutting device motor to cut the asphalt into a size equivalent to the surface area of the pothole based on the image information, operates the crushing motor of the crushing, device to crush the asphalt, operates the asphalt vacuum suction device to suck in the crushed asphalt and store the crushed asphalt in the residue storage tank, operates the air supply pump (925) to supply air through the air supply nozzle and clean the pothole, controls an asphalt concrete volume calculation part to calculate the amount of asphalt concrete required based on the surface area of the pothole received from the laser camera part, operates the asphalt concrete supply pump (740) to supply the asphalt concrete into the pothole through the supply channel (807) formed inside the multi main shaft, controls the asphalt concrete volume calculation part to calculate the amount of asphalt concrete from a weight of the asphalt concrete received from a digital gauge installed at the bottom of the asphalt concrete storage tank, stores the amount of asphalt concrete on an asphalt concrete DB, and controls operation of a roller part (677) of the multi operation device to flatten the asphalt concrete.

2. The vehicle system of claim 1, wherein the laser camera part is installed on a bottom side of the vehicle body and comprises:

a laser transceiver part (811) that shoots and receives laser at the pothole;

a distance calculation part (813) that calculates distance based on transmission and reception signals of the laser;

a surface area calculation part (815) that calculates the surface area of the pothole based on the image information taken from the pothole and the distance information calculated by the distance calculation part;

a transceiver part (817) that transmits and receives the surface area information and the image information to and from the vehicle device; and a control part (819) that controls the laser transceiver part, the distance calculation part, the surface area calculation part and the transceiver part.

3. The vehicle system of claim 1, wherein the multi operation device (600) comprises:

a plurality of operation bars (640) connected to the first support shaft (820);

a cutting rotation motor shaft (650) connected to the plurality of operation bars (640);

a cutting motor (660) that rotates the cutting rotation motor shaft;

two second brackets (670) connected to the cutting rotation motor shaft (650) at both ends;

a flattening part (672) connected to the front side of the two second brackets (670) to flatten asphalt concrete;

a roller part (677) connected to the two second brackets (670) and including a roller motor to flatten the pothole supplied with asphalt concrete; and a cutting blade (679) connected at both ends of the cutting rotation motor shaft (650) and including a blade motor.

4. The vehicle system of claim 1, wherein the vehicle device comprises a main control part (790) with a main transceiver part (780) to transmit and receive data to and from the laser camera part, and wherein the vehicle device controls the heating device (860) by turning the power switch of the heating device ON and OFF, controls and operates the laser camera part (810), displays the image information received from the laser camera part on the display part (777), stores the image information on the image DB (770), stores the surface area information of the pothole received from the laser camera part on the surface area DB (760), operates a blade motor of a cutting device of the multi operation device (600) to cut the pothole based on the image information, operates the crushing motor of the crushing device (850) to crush the asphalt, operates the asphalt vacuum suction device (870) to suck in the crushed asphalt and store the crushed asphalt in the residue storage tank, operates the air supply pump (925) to supply air through the air supply nozzle (920) and clean the pothole, controls the asphalt concrete volume calculation part (730) to calculate the amount of asphalt concrete required based on the surface area information of the pothole received from the laser camera part, operates the asphalt concrete supply pump (740) to supply the asphalt concrete in the asphalt concrete storage tank to the pothole based on the amount of asphalt concrete required, controls the asphalt concrete volume calculation part to calculate the amount of asphalt concrete from asphalt concrete weight information of the asphalt concrete storage tank received from the digital gauge installed at the bottom of the asphalt concrete storage tank, stores the amount of asphalt concrete supplied on the asphalt concrete DB (750), controls a motor of a rack/gear part (610) and an operating motor of the first rotation operating part (630), and controls operation of the roller part of the multi operation device (600).

5. The vehicle system of claim 1, wherein the heating device comprises:

a heating plate (862) installed on the front bottom surface of the vehicle body;

a switching part controlled by the vehicle device to turn power supply of the heating plate ON and OFF;

a vertical operating cylinder (866) connected to the heating device to move the heating device vertically; and a forward-reverse operating cylinder (868) to move the heating device back and forth.

6. A vehicle system for automatic repairing of road potholes on a road, the vehicle system comprising:

a vehicle (800) that transports asphalt concrete to a pothole;

a laser camera part (810) that is installed on a bottom side of a vehicle body and comprised of:

a laser transceiver part (811) that shoots and receives laser at the pothole, a distance calculation part (813) that calculates distance based on transmission and reception signals of the laser, a surface area calculation part (815) that calculates a surface area of the pothole based on image information taken from the pothole and distance information calculated by the distance calculation part, a transceiver part (817) that transmits and receives the surface area information and the image information to and from a vehicle device, and a control part (819) that controls the laser transceiver part, the distance calculation part, the surface area calculation part and the transceiver part;

a first support shaft (820) that is installed on a multi main shaft connected to the vehicle to move back and forth;

a multi operation device (600) that cuts asphalt and flattens asphalt concrete by vertically moving with a first rotation operating part connected to the first support shaft (820) and is comprised of a plurality of operation bars (640) connected to the first support shaft (820), a cutting rotation motor shaft (650) connected to the plurality of operation bars (640), a cutting motor (660) that rotates the cutting rotation motor shaft, two second brackets (670) connected to the cutting rotation motor shaft (650) at both ends, a flattening part (672) connected to the front side of the two second brackets (670) to flatten asphalt concrete, a roller part (677) connected to the two second brackets (670) and including a roller motor to flatten the pothole supplied with asphalt concrete, and a cutting blade (679) connected at both ends of the cutting rotation motor shaft (650) and including a blade motor;

a crushing device (850) that is connected to the first support shaft (820), and finely crushes the asphalt on the pothole by moving vertically, operating a crushing motor and rotating a grinder blade (851);

a heating device (860) that is connected to the bottom front side of the vehicle body, and heats and melts the asphalt by moving vertically or back and forth through operation of a vertical operating cylinder and a forward-reverse operating cylinder;

an asphalt vacuum suction device (870) that is installed in the back of the vehicle to suck in the crushed asphalt by a vacuum pump installed inside the vehicle and to store the asphalt in a residue storage tank;

an asphalt concrete storage tank (880) that stores the asphalt concrete;

an asphalt concrete supply pump (740) that supplies the asphalt concrete stored in the asphalt concrete storage tank to the pothole through a supply channel (807) formed inside the multi main shaft (805);

a residue storage tank (890) that gathers and stores the crushed asphalt sucked in by the asphalt vacuum suction device;

an oil supply nozzle (910) that operates an oil supply pump to supply oil stored in an oil tank for increased adhesion of the asphalt concrete to the pothole;

an air supply pump (925) that is installed inside the vehicle to clean up the pothole using strong air from an air supply nozzle (920); and a vehicle device (700) that is installed on driver's seat of the vehicle, operates a power switch connected to the heating device for power supply, controls operation of the laser camera part, displays the image information received from the laser camera part on a display part, stores the image information on an image DB, stores the surface area of the pothole received from the laser camera part on a surface area DB, operates a cutting device motor to cut the asphalt into a size equivalent to the surface area of the pothole based on the image information, operates the crushing motor of the crushing device to crush the asphalt, operates the asphalt vacuum suction device to suck in the crushed asphalt and store the crushed asphalt in the residue storage tank, operates the air supply pump (925) to supply air through the air supply nozzle and clean the pothole, controls an asphalt concrete volume calculation part to calculate the amount of asphalt concrete required based on the surface area of the pothole received from the laser camera part, operates the asphalt concrete supply pump (740) to supply the asphalt concrete into the pothole through the supply channel (807) formed inside the multi main shaft, controls the asphalt concrete volume calculation part to calculate the amount of asphalt concrete from a weight of the asphalt concrete received from a digital gauge installed at the bottom of the asphalt concrete storage tank, stores the amount of asphalt concrete on an asphalt concrete DB, and controls operation of a roller part (677) of the multi operation device to flatten the asphalt concrete.

* * * * *